US006523516B1

(12) United States Patent
Gerhard

(10) Patent No.: US 6,523,516 B1
(45) Date of Patent: Feb. 25, 2003

(54) INTAKE SYSTEM FOR AN INTERNAL COMBUSTION ENGINE

(75) Inventor: Hans-Martin Gerhard, Freiberg (DE)

(73) Assignee: Dr. Ing. h.c.F. Porsche AG, Weissach (DE)

( * ) Notice: Subject to any disclaimer, the term of this patent is extended or adjusted under 35 U.S.C. 154(b) by 0 days.

(21) Appl. No.: 09/543,784

(22) Filed: Apr. 6, 2000

(30) Foreign Application Priority Data

Apr. 7, 1999 (DE) ..... 199 15 592

(51) Int. Cl.[7] ..... F01N 1/06
(52) U.S. Cl. ..... 123/184.21
(58) Field of Search ..... 123/184.21; 181/229

(56) References Cited

U.S. PATENT DOCUMENTS 2,881,860 A * 4/1959 Ternes ..... 181/229
4,483,413 A * 11/1984 Ohashi ..... 181/229
4,727,651 A * 3/1988 Nakajima ..... 181/229
4,887,692 A * 12/1989 Outani et al. ..... 181/229
5,471,707 A * 12/1995 Kang ..... 181/229
5,573,371 A * 11/1996 Kieffer ..... 181/229
5,979,013 A * 11/1999 Beckey et al. ..... 181/229
5,996,734 A * 12/1999 Lam et al. ..... 181/229

FOREIGN PATENT DOCUMENTS

| | | |
|---|---|---|
| DE | 30 11 294 | 10/1981 |
| DE | 3742322 | 7/1988 |
| DE | 44 35 296 | 4/1996 |
| EP | 0435588 | 7/1991 |
| EP | 0681898 | 11/1995 |

OTHER PUBLICATIONS

Copy of Search Report.

* cited by examiner

*Primary Examiner*—Noah P. Kamen
*Assistant Examiner*—Jason Benton
(74) *Attorney, Agent, or Firm*—Crowell & Moring LLP

(57) ABSTRACT

An internal combustion engine element may be an air filter or a suction system of an internal-combustion engine. Both have a housing with walls which bound an interior of the housing, through which interior intake air flows during the operation of the internal-combustion engine. For achieving advantageous psycho-acoustic effects, the walls are provided with relatively thin-walled surfaces for achieving defined frequencies.

22 Claims, 1 Drawing Sheet

INTAKE SYSTEM FOR AN INTERNAL COMBUSTION ENGINE

BACKGROUND AND SUMMARY OF THE INVENTION

This application claims the priority of German application 199 15 582.5, filed in Germany on Apr. 7, 1999, the disclosure of which is expressly incorporated by reference herein.

The invention relates to an intake system for an internal-combustion engine which includes a housing with walls bounding an interior space through which engine intake air flows.

Products with an acoustically perceivable sound radiation are judged favorably if their sound effect is pleasant to the human ear. This applies mainly to passenger cars which are driven by means of internal-combustion engines and whose occupants, specifically the driver, consider the sound make-up important which is induced by the internal-combustion engine. The qualify of the sound make-up of an internal-combustion engine is relevant and can be optimized by utilizing the knowledge acquired from the technical field of noise, vibration and harshness (NVH).

A known intake system (German Patent Document DE 30 11 294 C2) comprises a housing with an air intake pipe and a line connected with a suction pipe. The housing has walls which bound a chamber through which intake air flows.

It is an object of the invention to take such measures on an intake system that the sound structure induced by it is advantageous to the human hearing.

According to the invention, this object is achieved by providing an intake system for an internal-combustion engine, comprising a housing with walls, which walls bound an interior space through which intake air flows, wherein the walls are provided with relatively thin-walled surface sections for achieving defined frequencies.

The principal advantages achieved by means of the invention are that the intake system radiates frequencies which are defined by the thin-walled surfaces mounted on the wall of the housing, which frequencies are in a defined relationship according to the science of harmony and exercise a targeted and advantageous psycho-acoustic effect on the human hearing. As the result of the corresponding design of the housing, the surfaces can be integrated in the housing at acceptable expenditures. A particularly advantageous function is achieved if the surfaces are mounted on walls of a receptacle of a suction system. Finally, the frequency radiation can be optimized in a targeted manner by means of the mass-type parts mounted on the surfaces.

Other advantages, features, and details of the invention will be found in the description below in which a number of embodiments of the invention are described in detail with reference to the drawings. The features referred to in the claims and the specification may be important to the invention individually or in any combination.

DETAILED DESCRIPTION OF THE DRAWINGS

Figure 1:
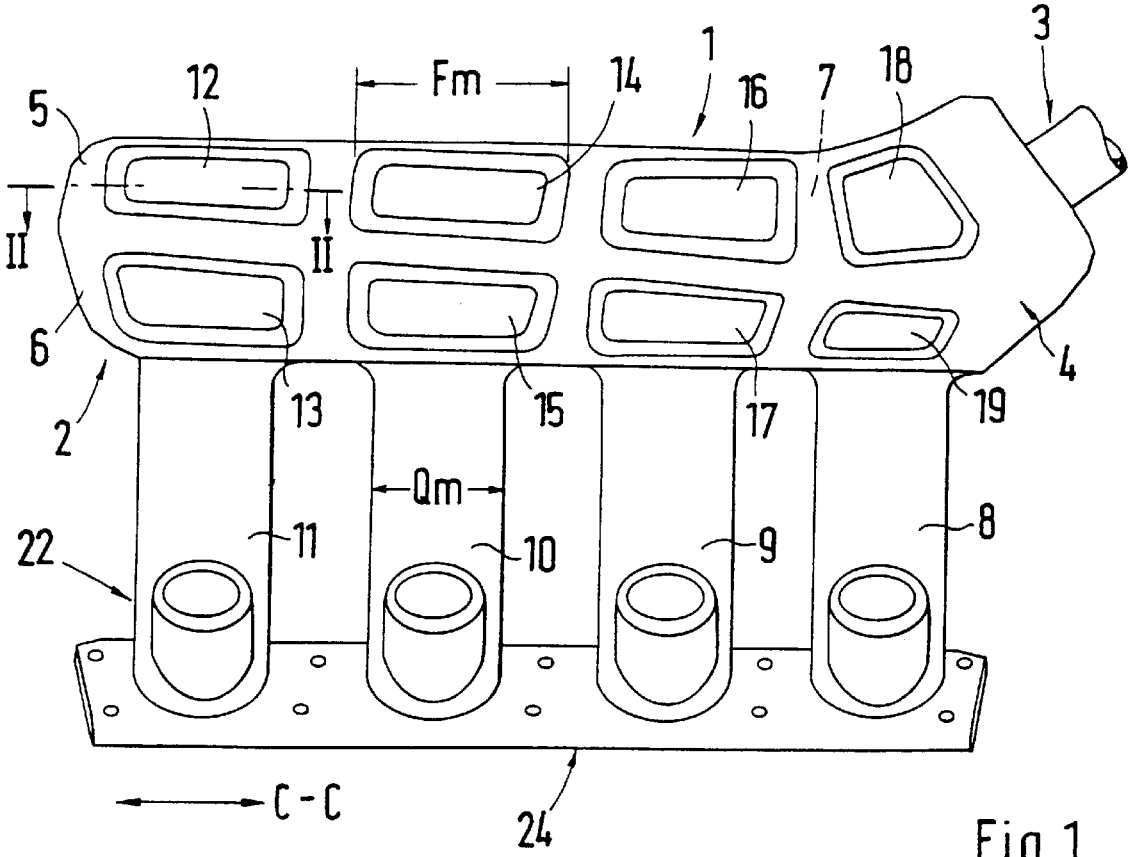
FIG. 1 is a view of an intake system for an internal-combustion engine which is formed by a suction system, constructed according to preferred embodiments of the invention.

An internal-combustion engine, which is not shown in detail, comprises an intake system 1 which, in the embodiment shown, includes a suction system 2 with a housing, and a container 4 as an intake element. An air filter with a housing can also be provided as an intake element of an intake system according to contemplated embodiments.

As reference number 3, the suction system 2 has an air inlet which leads into a container 4. A throttle valve connection piece, which is not shown in detail, is connected in front of the air inlet. The container 4 comprises walls 5, 6 which bound an interior 7. During the operation of the internal-combustion engine, intake air flows through interior 7.

Four feed pipes 8, 9, 10 and 11 lead away from the container 4 and connect at reference number 24 to a cylinder head of the internal-combustion engine. The suction system 2 made of metal, plastic or the like is constructed for an installation into a series-produced internal-combustion engine, but it is also conceivable to adapt it to other types of constructions of internal-combustion engines.

Figure 2:
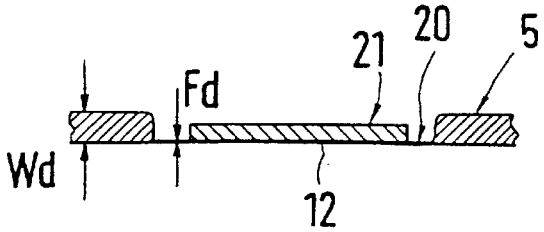
FIG. 2 is a sectional view taken along Line II—II of FIG. 1.

Relatively thin-walled housings 12, 13; 14, 15; 16, 17; 18, 19, which are constructed in the manner of a membrane, are provided on the walls 5, 6 and are thinner-walled than the remaining area of the walls 5, 6, that is, outside these surfaces, which is expressed by means of Fd (surface thickness)<Wd (wall thickness). In principle, the surface 12 is illustrated in FIG. 2, being provided on an interior side 20 with a mass-type part 21 constructed like a plate, which mass-type part is provided only in the are of the surface 12 and is held in position by suitable measures.

The surfaces 12, 13; 14, 15; 16, 17; 18, 19 may be round, square or rectangular. However, different configurations, such as elliptical, polygonal or similar configurations are conceivable. In addition, the surfaces may have different sizes; for example, surface 18>surface 19. The shape, size and position of these surfaces with respect to one another can be determined mathematically or iteratively.

The surfaces 12, 13; 14, 15; 16, 17, 18, 19 are provided in the area of the feed pipes 8, 9, 10, 12 which extend at a distance from one another and at reference number 22 are provided with a pipe connection piece for injection nozzles. In this case, viewed in the longitudinal direction C—C of the container 4, at least the surfaces 14, 15 have a surface measurement Fm which is wider than the cross-sectional measurement Qm of the corresponding feed pipe, such as 10.

Figure 3:
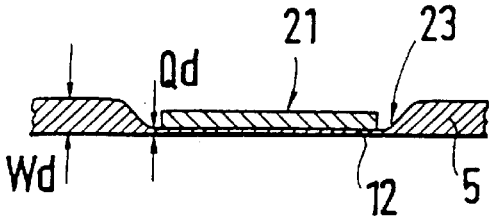
FIG. 3 is a view corresponding to FIG. 2 showing another embodiment of the invention.

According to FIG. 3, the surface 12 is formed by a local tapering Qd of the cross-section, whose thickness is smaller than the thickness Wd of the wall 5. Finally, the transition between Wd and Qd is indicated at reference number 23.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Intake system for an internal-combustion engine, comprising a housing with walls, which walls bound an interior space through which intake air flows, wherein the walls are provided with relatively thin-walled surface sections for achieving defined frequencies, and wherein the surface sections are formed by local taperings of the cross-sections of the walls.

2. Intake system according to claim 1, wherein the surface sections have a circular, square or rectangular construction.

3. Intake system according to claim 1, wherein the walls are provided with surface sections of different sizes.

4. Intake system according to claim 1, wherein said housing is a container housing of a suction system and has feed pipes connected to a cylinder head of the internal-combustion engine, and wherein the surface sections are provided on walls of the container housing in an area of the feed pipes.

5. Intake system according to claim 4, wherein the surface sections are at least partially wider than the feed pipes.

6. Intake system according to claim 5, wherein all of the surface sections are approximately square.

7. Intake system according to claim 1, wherein the surface sections are formed by local taperings of the cross-sections of the walls.

8. Intake system according to claim 1, wherein the surface sections are provided with metallic mass-type parts.

9. Intake system according to claim 8, wherein the mass-type parts are constructed in the manner of plates.

10. Intake system according to claim 2, wherein the walls are provided with surface sections of different sizes.

11. Intake system according to claim 2, wherein said housing is a container housing of a suction system and has feed pipes connected to a cylinder head of the internal-combustion engine, and wherein the surface sections are provided on walls of the container housing in an area of the feed pipes.

12. Intake system according to claim 3, said housing is a container housing of a suction system and has feed pipes connected to a cylinder head of the internal-combustion engine, and wherein:

the surface sections are provided on walls of the container housing in an area of the feed pipes.

13. Intake system according to claim 1, wherein said housing is part of a suction system.

14. Intake system for an internal-combustion engine, comprising a housing with walls, which walls bound an interior space through which intake air flows, wherein the walls are provided with relatively thin-walled surface sections for achieving defined frequencies, and wherein said housing is an air filter housing.

15. An air intake system for an internal-combustion engine, comprising a housing with housing walls enclosing an air intake space through which intake air flows during use thereof on an operating engine, wherein said walls have a first basic housing wall thickness adjoined by thinner walled housing wall surface sections which are configured as membranes to achieve defined acoustic characteristics of the intake system during engine operations.

16. An air intake system according to claim 15, wherein said housing is disposed downstream of an air inlet leading into the housing.

17. An air intake system according to claim 16, wherein a plurality of feed pipes lead away from the housing and connect to an engine cylinder head.

18. An air intake system according to claim 17, wherein respective thinner walled housing wall surface sections are provided for each of the feed pipes.

19. An air intake system according to claim 18, wherein the thinner walled housing wall surface sections are wider than respective associated openings in the housing to the feed pipes.

20. An air intake system according to claim 19, wherein a plurality of the thinner walled housing wall surface sections have different sizes with respect to each other.

21. Intake system according to claim 14, wherein the surface sections have a circular, square or rectangular construction.

22. Intake system according to claim 14, wherein the walls are provided with surface sections of different sizes.

* * * * *